US009103630B1

(12) United States Patent
McCoy

(10) Patent No.: US 9,103,630 B1
(45) Date of Patent: Aug. 11, 2015

(54) SLIDING SIGHT LEVEL FOR FIREARM

(71) Applicant: Charles A McCoy, Bellingham, WA (US)

(72) Inventor: Charles A McCoy, Bellingham, WA (US)

( * ) Notice: Subject to any disclaimer, the term of this patent is extended or adjusted under 35 U.S.C. 154(b) by 64 days.

(21) Appl. No.: 13/797,465

(22) Filed: Mar. 12, 2013

Related U.S. Application Data

(60) Provisional application No. 61/751,786, filed on Jan. 11, 2013.

(51) Int. Cl.
*F41G 1/00* (2006.01)
*F41G 1/44* (2006.01)

(52) U.S. Cl.
CPC ..... *F41G 1/44* (2013.01)

(58) Field of Classification Search
CPC ..... F41G 1/44
USPC ..... 42/1.01, 90, 111, 135; 33/283, 290, 33/265, 263
See application file for complete search history.

(56) References Cited

U.S. PATENT DOCUMENTS

| | | | | |
|---|---|---|---|---|
| 191,389 | A | 5/1877 | Ward et al. | |
| 2,529,801 | A | 11/1950 | Fisk | |
| 2,782,511 | A | 9/1954 | Ivy | |
| 2,748,494 | A | 6/1956 | Raney | |
| 5,005,308 | A | 4/1991 | Parks | |
| 5,223,650 | A | 6/1993 | Finn | |
| 5,315,781 | A | 5/1994 | Beisner | |
| 5,406,733 | A | 4/1995 | Tarlton et al. | |
| 5,630,279 | A | 5/1997 | Slates | |
| 5,657,571 | A | 8/1997 | Peterson | |
| 5,878,504 | A * | 3/1999 | Harms | 42/120 |
| 6,978,569 | B2 | 12/2005 | Williamson, IV et al. | |
| 7,530,193 | B2 | 5/2009 | Williamson, IV et al. | |
| 8,051,574 | B1 * | 11/2011 | Kronengold et al. | 33/265 |
| 8,695,266 | B2 * | 4/2014 | Moore et al. | 42/116 |
| 8,819,985 | B1 * | 9/2014 | McCoy et al. | 42/111 |
| 2006/0101700 | A1 | 5/2006 | Williamson, IV et al. | |
| 2006/0162227 | A1 | 7/2006 | Samson | |
| 2007/0113460 | A1 * | 5/2007 | Potterfield et al. | 42/120 |
| 2007/0175080 | A1 | 8/2007 | Sammut et al. | |

OTHER PUBLICATIONS

Canadian Airgun Forum, Mounting Solutions Anti-Cant Device, <http://www.airgunforum.ca/forums/topic23441.html>, Sep. 14, 2008.

(Continued)

*Primary Examiner* — J. Woodrow Eldred
(74) *Attorney, Agent, or Firm* — Michael R. Schacht; Schacht Law Office, Inc.

(57) ABSTRACT

Described herein is a removable sight level for a firearm. The sight level includes a lower clamp member. Also disclosed is an upper clamp member attached to the lower clamp member. A level indicator holder having a plurality of level indicator holder voids aligned with the upper clamp member voids is adjustably attached to the upper clamp member. At least one fastener may be utilized, at least partially within one of the level indicator voids and partially within one of the upper clamp member voids being tensionable there between so as to selectively prohibit movement between the upper clamp member and the level indicator holder. At least one of the voids is elongated and has a radially convex surface so as to allow selective arcuate movement between the upper clamp member and the level indicator holder when the fasteners are not tensioned.

19 Claims, 6 Drawing Sheets

(56) References Cited

OTHER PUBLICATIONS

Junk Yard Genius, Mounting Solutions Anti-Cant Device, <http://web.archive.org/web/20070524174824/http://www.junkyardgenius.com/firearms/varmint/varmint01.html>, May 24, 2007.

Western Shooter, Mounting Solutions Anti-Cant Device, <http://www.westernshooter.com/2008/04/acd-anti-cant-device-review.html>, Apr. 18, 2008.

USPTO, U.S. Appl. No. 12/973,567 Non-Final Office Action, Aug. 21, 2012, 11 pages.

USPTO, U.S. Appl. No. 12/973,567 Non-Final Office Action, Feb. 20, 2013, 11 pages.

USPTO, U.S. Appl. No. 12/973,567 Non-Final Office Action, May 29, 2013, 30 pages.

* cited by examiner

SLIDING SIGHT LEVEL FOR FIREARM

RELATED APPLICATIONS

This application, U.S. patent application Ser. No. 13/797,465 filed Mar. 12, 2013, claims benefit of U.S. Provisional Patent Application Ser. No. 61/751,786 filed Jan. 11, 2013.

BACKGROUND OF THE DISCLOSURE

Field of the Disclosure

This disclosure relates to the field of firearm sights and sighting appendages.

SUMMARY OF THE DISCLOSURE

Disclosed herein is a removable sight level for a firearm comprising: a lower clamp member having a first end and a second end. Also disclosed is an upper clamp member having a first end attached to the first end of the lower clamp member, a second end attached to the second end of the lower clamp member, and a plurality of upper clamp member voids parallel to a sight axis of the firearm. A level indicator holder having a plurality of level indicator holder voids aligned with the upper clamp member voids is positionably attached to the upper clamp member. At least one fastener may be utilized, at least partially within one of the level indicator voids and partially within one of the upper clamp member voids being tensionable there between so as to selectively prohibit movement between the upper clamp member and the level indicator holder. At least one of the voids is elongated and has a radially convex surface so as to allow selective arcuate movement between the upper clamp member and the level indicator holder when the fasteners are not tensioned.

DESCRIPTION OF THE PREFERRED EMBODIMENTS

Figure 1:
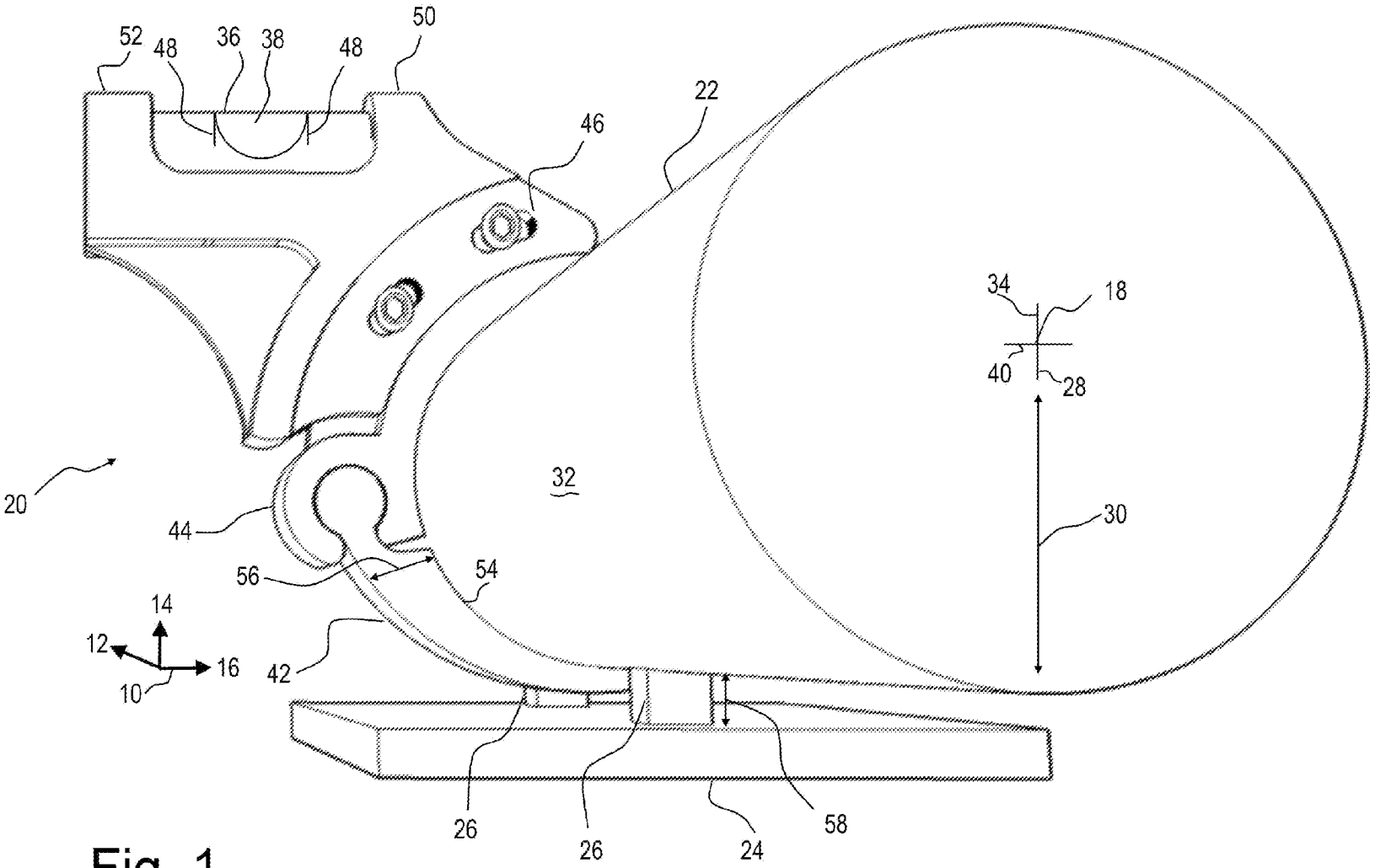
FIG. 1 is an isometric view of one example of the apparatus attached to a highly schematic sight and firearm.

Firearms are commonly equipped with sighting apparatuses, such as aiming scopes, mounted above barrel of the firearm. These sighting apparatuses perform best when two planes, a plane defined by a line through the center of the gun barrel and the sight line of the scope, which will be referred to as the shooting plane, and a second plane defined by a line through the center of the firearm barrel and a line perpendicular to the horizon, which will be referred to as the vertical plane, are coincident, or, in other words, lie in the same plane.

Reticle lines or "cross hairs" in the viewing area of common scope style sighting apparatuses facilitate alignment of the shooting plane with the vertical plane. When the sighting apparatus is installed on the firearm, it is positioned substantially on top of and centered vertically above the firearm barrel. A vertical cross hair in the sight viewing area is aligned so that an extension of the cross hair in the direction of the gun barrel would pass through the centerline of the gun barrel. Thus, the vertical cross hair is a visual indicator of the shooting plane of the firearm.

By looking through the firearm scope and comparing the vertical cross hair to an object appearing in the sight known to be vertical, such as the side of a tall building, or alternately comparing the horizontal cross hair in the sight to a known horizontal object, such as the horizon, the user receives visual confirmation that the shooting plane is aligned with the vertical plane. This plane alignment is commonly called "plumb".

In many circumstances, however, a good horizontal or vertical visual reference is not available, and the firearm operator can only estimate the vertical plane. The known prior art proposes several level or plumb indicating devices to assist in finding the vertical plane. Bubble levels and electronic devices for both in-sight and out-of-sight indication are some examples commercially available. In-sight indicators show the reference to vertical within the viewing area of the sighting apparatus, while out-of-sight indicators show the reference to vertical outside the scope viewing area.

In-scope indicators are typically complex, expensive and can detract from the original telescopic viewing/aiming design of the sighting apparatus. Such in-scope indicators are often difficult or impossible to add to the scope sighting apparatus) after manufacture of the scope as an after-market, add-on product. Out-of-sight indicators can be complex and/or expensive, but also can have additional problems, such as being located on the scope in a poor viewing position, thus being difficult for the operator to see while shooting, or being physically unprotected from damage, especially while the firearm is being carried and not used for shooting.

Prior art out-of-sight level indicating devices are commonly attached to sighting apparatus using half round collars or straps that employ fasteners at both strap ends to connect the strap to the rest of the device. This configuration of strap and fasteners often mandates ends on the strap that are often too large to fit between many sighting apparatuses and the firearm, thus requiring the user to remove the sighting apparatus from the firearm to install the level indicating device.

Removing and re-installing a sighting apparatus can be tedious and time-consuming. Thus, it is desirable to avoid removal and re-installation of the sighting apparatus, such as when adding accessories, such as a sight level. When fastening a level indicating device to a sighting apparatus, it is often difficult to precisely maintain the desired relationship between the shooting plane and a level position of the level indicating device. As the fasteners are tightened, the level indicating device tends to move on the scope, thus losing the desired alignment of the level indicating device.

Referring to FIG. 1 a highly schematic scope 22 is shown mounted above a highly schematic shortened section of a firearm 24. The sighting apparatus (scope 22) is mounted to the firearm 24 by way of offset mounts 26 which generally keep the outer surface 32 of the scope offset from the adjacent surface of the firearm. In this example, a level indicating device 20 is shown mounted on scope 22. In this disclosure, the term scope is used generally interchangeably with the term sighting apparatus, as both are substantially equivalent relevant in many functional respects.

Before continuing a detailed description, an axes system 10 is disclosed, generally comprising a longitudinal axis 12 aligned with and parallel to the sight axis 18 of the scope 22 as well as a vertical axis 14 and a transverse axis 16 orthogonal to the vertical axis 14 and longitudinal axis 12. These axes are intended to aid in description and are not intended to limit the apparatus to a particular operating orientation.

Reticule lines or "cross hairs" 28 within the viewing area of the scope 22 facilitate alignment of the shooting plane with the vertical plane. When the sighting apparatus 22 is installed on the firearm 24, a vertical cross hair 34 in the sight viewing area represents the shooting plane and is aligned so that an extension of the vertical cross hair toward the gun barrel would pass through the centerline 52 of the gun barrel. The horizontal cross hair 40 is orthogonal to the vertical cross hair 34 and to the sight axis 18. Thus, the vertical cross hair is a visual indicator of the shooting plane of the firearm.

In use, as previously mentioned, the shooter aims the firearm 24 at a target while looking at the target through the scope 22. While doing so, the shooter attempts to hold firearm 22 and attached scope 22 such that the shooting plane 30 and vertical plane 14 are aligned. By looking through the firearm scope and comparing the vertical cross hair 34 to a distant object appearing in the sight known to be vertical, such as the side of a tall building, a tree, fencepost, or alternately by comparing the horizontal cross hair 40 in the sight to a known horizontal object, such as the horizon above a large body of water, the user receives (interprets) visual confirmation that the shooting plane is aligned with the vertical plane, or the shooting plane.

When a horizontal or vertical visual reference is not available, without a level indicating device the firearm user can only estimate the vertical/horizontal planes. With the aid of a level indicating device, such as the level indicating device 20 shown in the Figs, the user no longer has to estimate the vertical plane, as the vertical plane 14 is visually represented by a level indicator (bubble vial) 36 on the level indicating device 20. In the case of the embodiment of the level indicating device 20, the indicator is a gravity driven bubble 38 in a typical level indicator 36. The level indicator component may alternatively be an electronic device with lights and/or audio tones which indicate to the shooter that the shooting plane is plumb. Electronic indicators can be driven by liquid level sensor(s), pendulum(s) with proximity sensor(s), magnetic field sensor(s), mercury switches, or electronic components and circuitry.

The component of the level indicating device that actually does the sensing may be constructed to sense either horizontal or vertical planes, but for this application, the level indicator (bubble vial 36) indicates the horizontal plane and is integrated into the level indicating device 20 such that when the level indicating device 20 indicates a level or plumb orientation of the firearm 24 to the firearm operator, the level indicating device indicates to the firearm operator that the shooting plane is aligned with the vertical plane. For example, the level indicating device 20 in FIG. 1 contains bubble level vial 36, which indicates to the user when bubble level vial 36 is positioned in a horizontal plane, by the presence of a bubble 6 appearing substantially centered between two lines 48 on bubble level vial 36. This orientation of the bubble between the lines indicates that the shooting plane is aligned with the vertical plane which, as previously described, is normally desired for accurate shooting of the firearm 24. If the level indicating device 20 is attached to the scope 22 such that the horizontal plane containing the long axis centerline of level indicator 36 is perpendicular to the shooting plane 30, then an indication of level in level indicator 36 is also an indication that the shooting plane 30 is aligned with the vertical plane.

The example of the sight level indicator shown in FIG. 1 generally comprises a lower clamp member 42 removably attached to an upper clamp member 44 as will be described. A level indicator (bubble vial) holder 46 holding the level indicator 36 is attached to the upper clamp member, such that the angle of the level indicator 36 to the transverse plane 16 may be adjusted. In a proper shooting orientation, the air or gas bubble 38 of the level indicator 36 should be centered between level indicators 48. Level indicators 48 may be printed or engraved on the bubble vial 36, or on the level indicator holder 46. Relative to the sight axis 18, the bubble level holder has a radially inward end 50 and a radially outward end 52.

In one form as shown in FIG. 1, a first end 54 of the lower clamp member 42 has a maximum thickness 56 which is less than the offset distance 58 between the firearm 24 and the outer surface 32 of the scope 22. This difference allows the sight level indicating apparatus 20 to be attached without removal of the scope 22.

Figure 2:
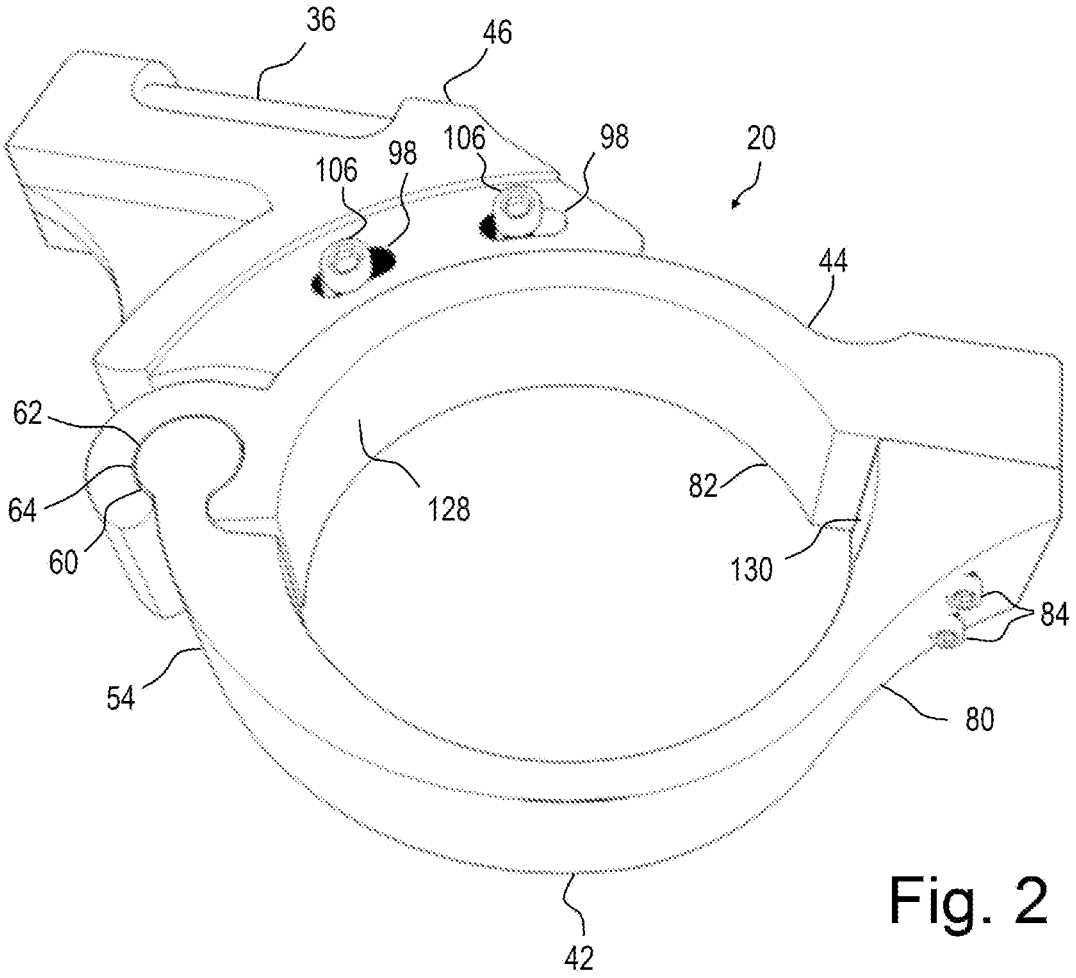
FIG. 2 is an isometric view of the example shown in FIG. 1 removed from the sight and firearm.

Looking to the example shown in FIG. 2, the first end 54 of the lower clamp member 42 is attached to the upper clamp member 44 by way of a cylinder and socket joint 60. The joint 60 comprises a cylinder 62 of the lower clamp member 42, and a socket 64 formed in the cooperating first end 66 of the upper clamp member 44.

Figure 6:
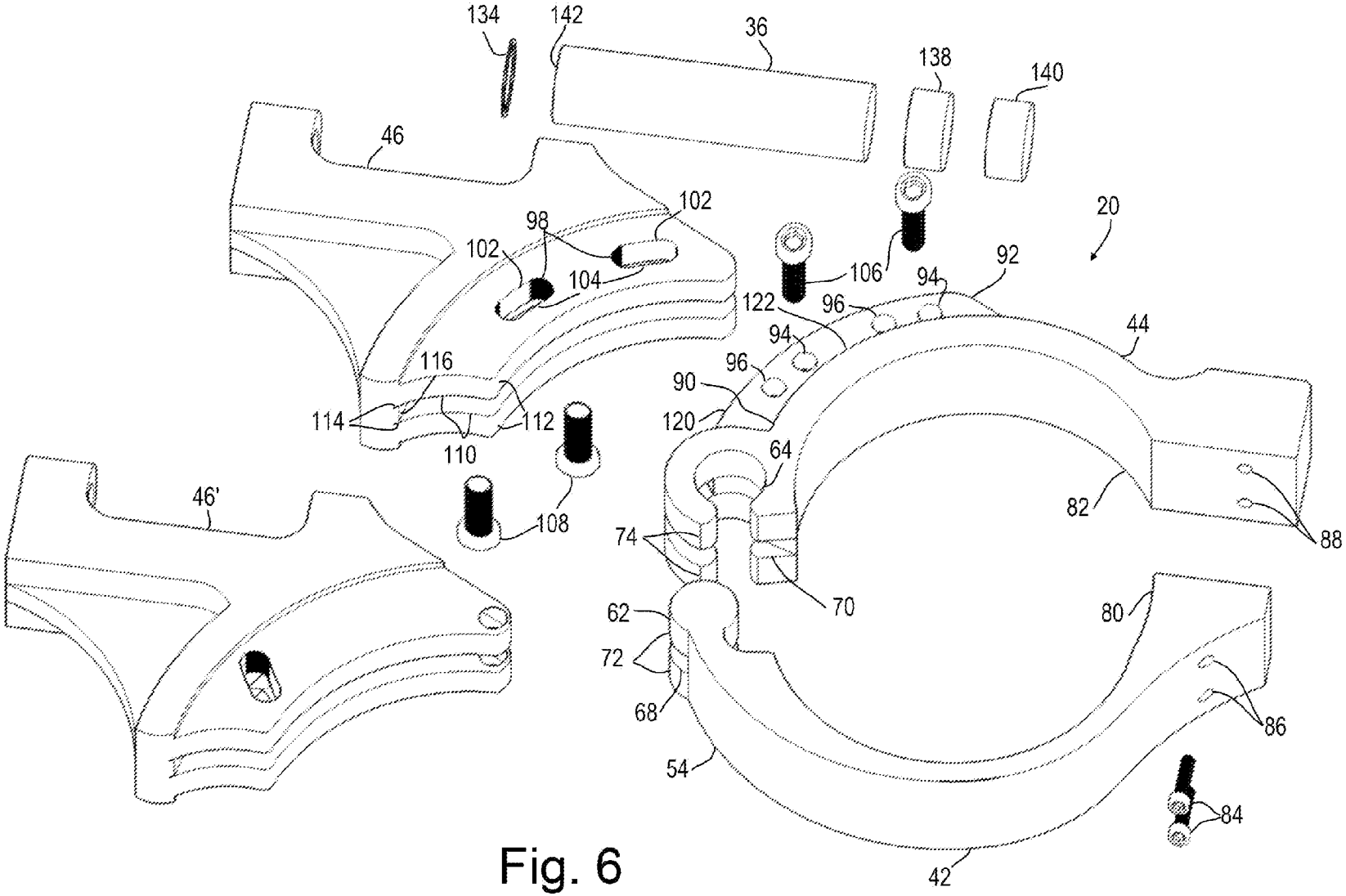
FIG. 6 is an exploded view of the main components of the apparatus.

In the example shown in FIG. 6, the cylinder 62 and the socket 64 each have a gap 68/70 respectively formed between longitudinal sub-portions thereof. The formation of these sub-portions and gap results in the cylinder 62 being formed of a plurality of fingers 72 having a thickness slightly less that the width of the gap 70. Likewise, the socket 64 may be formed of a plurality of fingers 74 having a thickness slightly less that the width of the gap 68. In this way, the fingers of the socket 64 fit substantially vertically through the gap 68, the fingers of the cylinder 62 fit through the gap 70, and thus less longitudinal movement is required to connect the cylinder and socket joint to the position shown in FIG. 2. This assembly arrangement may be very helpful if there is limited space between the scope 22 and firearm 24.

In the Example of FIG. 6, the second end 80 of the lower clamp member 42 is attached to the second end 82 of the upper clamp member 44 by way of fasteners 84 passing through clearance holes 86 and engaging threaded holes 88. In one form, threaded holes 88 may be provided on the opposing surface of the upper clamp member 44 as threaded nuts or similar elements. Once fastened, these fasteners 84 put the inner surface of the clamp members 42/44 in compression about the sighting apparatus 22. Other compression fasteners could also be utilized. The relative position of the threaded holes 88 and clearance holes 86 may be reversed.

Once the clamp member comprised of clamp members 42/44 is attached to the firearm, it is likely that the level indicator 48 is not initially properly aligned. Thus, it may be desired for minimal/fine adjustment of the level indicator 48 relative to the clamp member(s) 42/44. This fine adjustment is accomplished as shown below.

Still looking to FIG. 6, it can be seen that the radially outward surface 90 of the upper clamp member 44 in this example comprises a projection 92 having a plurality of surfaces defining threaded voids 94/96 therein. The threaded voids align with surfaces defining elongate voids 98/100 (see FIG. 3) in the level indicator holder 46. When fasteners 106/108 are threaded and sufficiently tensioned in place within the voids 94/96/98/100, the level indicator holder 46 is held in relative position to the upper clamp member 44. In one form, inner surfaces 110 of projections 112 (112'/112") slide along the projection 92 when tension is not provided by the fasteners 106/108. As the fasteners 106/108 are tensioned, the projections 112 deform towards and frictionally engage the longitudinal sides of the projection 92. Radially inward surfaces

116/118 of the projections 112 may ride upon radially outward surfaces 120/122 of the upper clamp member. In one example, relief cuts 114 may be provided in line with inner surfaces 110 to allow a more free movement of the projections 112 than would be allowed otherwise. This the relief cuts 114 provide a more face to face clamping force between the surfaces 110 as the axis of pivot will be moved away from the intersection of the surfaces 110 with the surface 116.

The surfaces defining voids 98/100 in one example are radially elongated in that their length in a tangential direction is larger than their length in a radial direction. In addition, the voids 98/100 have a concave surface 102 and a convex surface 104 having substantially the same axis of curvature so as to allow the level indicator holder 46 a few degrees of rotation relative to the upper clamp member 44. In one example, the center of curvature of these two surfaces is substantially the sight axis 18 of the scope 22. In a more general form, the center of curvature may be within the outer surface 32 of the scope 22. In one form, rotation of 90° or more may be possible, while rotation between 2° and 30° (or in a narrower range between 5° and 15°) may be sufficient assuming that the person installing the clamping members is sufficiently capable.

Figure 3:
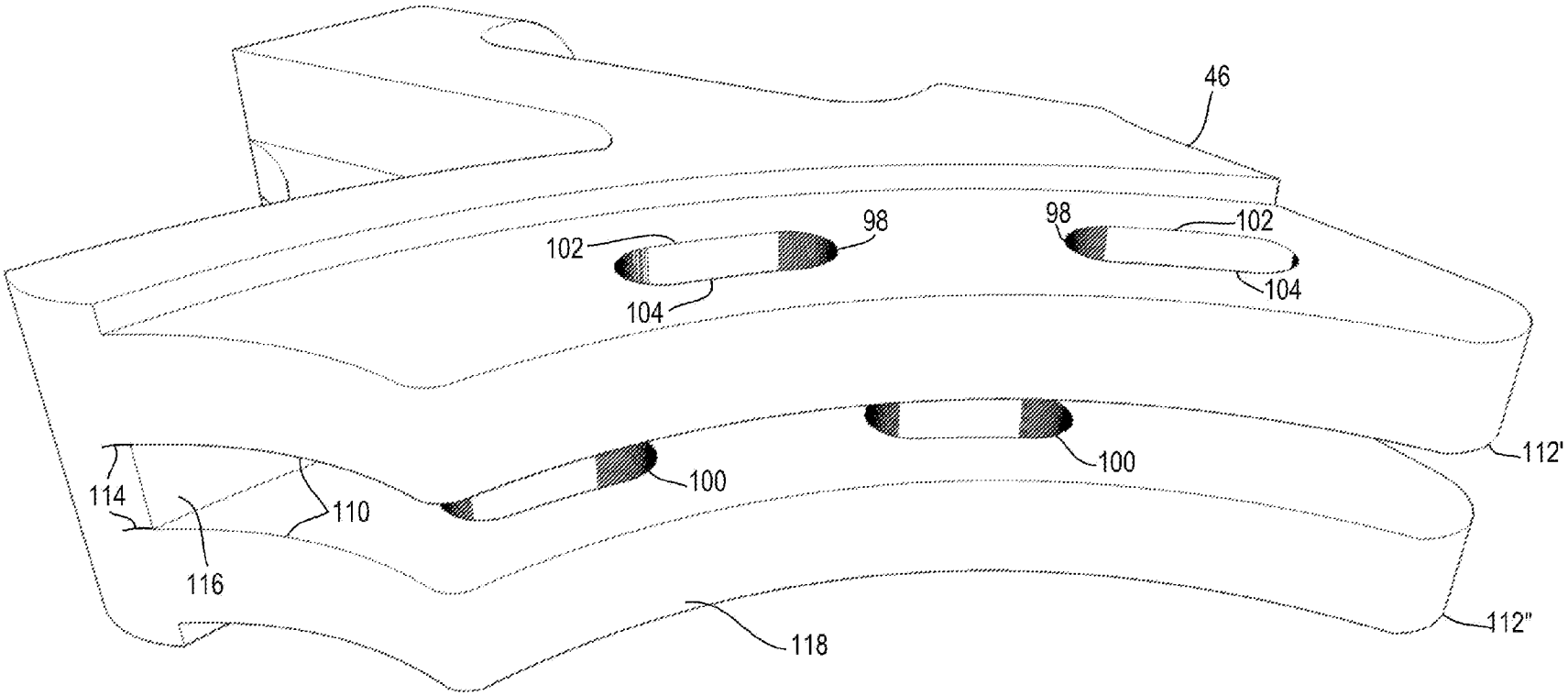
FIG. 3 is a detail enlarged view of one component of the apparatus shown in FIG. 2.

As can be better understood by looking to FIG. 3, the voids 98 in the first longitudinal projection 112' are circumferentially offset from the voids 100 in the second longitudinal projection 112". Likewise, the voids 94 are circumferentially offset from the voids 96. As the projection 92 may be relatively thin longitudinally, it may be desired to allow for as much longitudinal space as possible for the threads of the fasteners 106/108 if the voids 94/96 are threaded. Thus, in one example the fasteners 106 pass through the voids 98 into threaded voids 94, while fasteners 108 pass through voids 100 into threaded voids 96. This radially offset void arrangement allows for the fasteners 106/108 to engage more of the projection 92 than would be possible if the threaded voids 94/94 were axially aligned.

Figure 5:
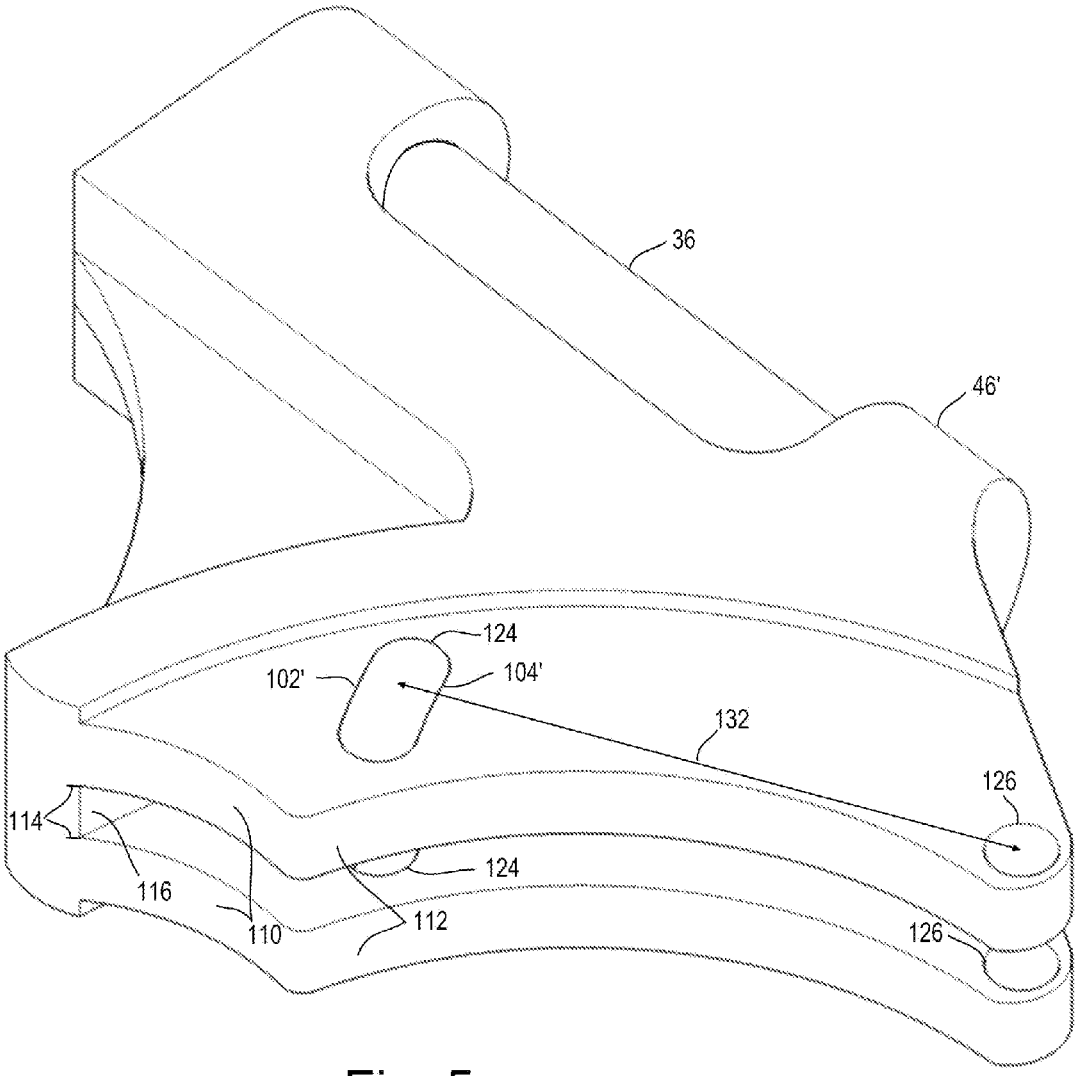
FIG. 5 is a detail enlarged view of one component of the apparatus shown in FIG. 2.

FIG. 6 also shows another example of the level indicator holder component 46'. FIG. 5 shows this level indicator holder component 46' in more detail. In this example, the convex surface 104' and concave surface 102' of the elongate void 124 have a radius of curvature 132 centered upon a cylindrical void 126. In this example, once the inner surfaces 128 and 130 of the upper and lower clamp members 44 and 42 respectfully are frictionally engaged to the outer surface of the scope 22, the level holder component 46' is attached if needed, and adjusted by rotation of the level indicator holder component 46' about fasteners passing through the voids 126/94 while the firearm is in a vertical position so that the shooting plane is aligned with the vertical plane. Once correctly positioned, fasteners 106 which pass through or are threaded into voids 126/94 and fasteners 108 which pass through voids 124/96 are then tensioned as with the previous example. Once these fasteners 106/108 are tensioned, the level indicator is held and fixed in the correct orientation.

Figure 4:
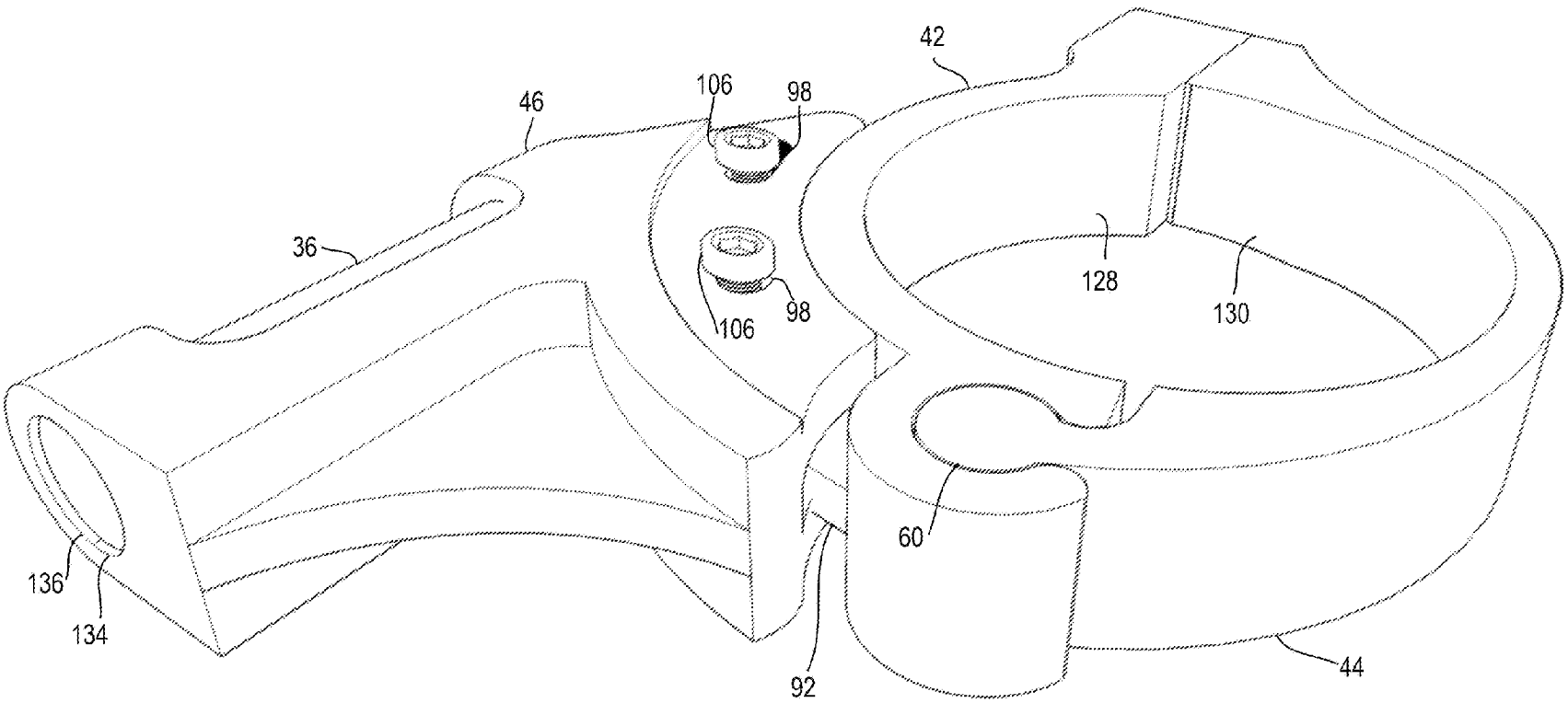
FIG. 4 is a detail view of the apparatus shown in FIG. 2 from a different angle.

As can be seen in FIG. 4, the level indicator 36 may be held within a cavity 136 of the level holder component by way of a retaining ring 134. In another example, the level indicator 36 may be held in place by a set screw, adhesive, press fit or other methods. The retaining ring 134 is also shown in FIG. 6 alongside the level indicator 36. To add functionality to the apparatus in low light situations, a light module 138 may be provided along with a power module 140 such as a battery. The light module 138 may be pressure sensitive, such that when a user pressed upon the outward end 142 of the apparatus, the light module 138 is activated and the level indicator 36 is illuminated for night or low light operations. The light module may alternatively be light activated, have an external switch, be capacitive sensing or otherwise activated.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A removable sight level for a firearm having a barrel and a sight with a longitudinal axis, the removable sight level comprising:

a clamp member removably attached to the firearm, the clamp member having at least one surface defining at least one clamp member void extending through at least a portion of the clamp member, wherein a relationship between the at least one clamp member void is fixed relative to the longitudinal axis of the firearm when the clamp member is attached to the firearm;

a level indicator holder attached to the clamp member;

the level indicator holder having at least one level indicator holder void aligned with the at least one clamp member void; and at least one fastener at least partially within at least one indicator holder void and at least partially within at least one clamp member void, the fastener being operable so as to selectively prohibit movement of the level indicator holder relative to the clamp member;

wherein the at least one level indicator void is defined by a concave surface and an opposing convex surface and is elongated so as to allow selective movement of the level indicator holder relative to the clamp member when the at least one fastener is operated to allow movement of the level indicator holder relative to the clamp member.

2. The removable sight level as disclosed in claim 1 wherein the clamp member comprises:

a lower clamp member having a first end and a second end; and an upper clamp member having a first end attached to the first end of the lower clamp member, a second end attached to the second end of the lower clamp member, and the defining the at least one clamp member void.

3. The removable sight level as disclosed in claim 1 wherein the at least one level indicator holder void is radially elongated such that the center of radial elongation is within the firearm sight.

4. The removable sight level as disclosed in claim 3 wherein at least one level indicator holder void is radially elongated such that the center of radial elongation is substantially at a longitudinal axis of the firearm sight.

5. The removable sight level as disclosed in claim 1 further comprising:

a first holder projection of the level indicator holder defining a first level indicator holder void;

a second holder projection of the level indicator holder defining a second level indicator holder void; and wherein a first fastener extends through the first level indicator holder void and into a first clamp member void; and wherein a second fastener extends through the second level indicator older void and into a second clamp member void.

6. The removable sight level as disclosed in claim 5 wherein a clamp member projection of the clamp member defines first and second clamp member voids, wherein the clamp member is located between the first and second holder projections when the first fastener extends through the first level indicator holder void and into the first clamp member void and the second fastener extends through the second level indicator holder void and into a second clamp member void.

7. The removable sight level as disclosed in claim 1 further comprising:

a light module; and a power module connected to the light module capable of selectively energizing the light module and illuminating a level indicator attached to the level indicator holder.

8. The removable sight level as disclosed in claim 1 wherein:

rotation of the clamp member about the firearm sight provides coarse adjustment of the level indicator holder relative to the firearm sight; and movement of the level indicator holder relative to the clamp member provides fine adjustment of the level indicator holder relative to the firearm sight.

9. The removable sight level as disclosed in claim 1 wherein the at least one clamp member void is threaded and the at least one fastener is threaded such that the at least one clamp member void engages the at least one fastener to selectively prohibit movement of the level indicator holder relative to the clamp member.

10. The removable sight level as disclosed in claim 1 wherein:

the first and second holder projections define a slot;

a clamp member projection is sized and dimensioned to fit within the slot such that the level indicator holder may be moved around the sight and to inhibit movement of the level indicator holder along the longitudinal axis of the sight.

11. The removable sight level as recited in claim 10, wherein the clamp member projection is sized and dimensioned to fit within the slot such that the level indicator holder may be moved around the sight in an arcuate path centered about the longitudinal axis of the sight.

12. A sight level for a sight of a firearm comprising:

a base defining a base projection defining at least one base void, where the base is secured relative to the sight;

a holder for a level indicator, the holder defining a holder projection defining at least one holder void;

at least one fastener adapted to extend at least partly through the at least one holder void and at least partly through the at least one base void; where at least one of the at least one base void and the at least one holder void are sized and dimensioned such that when the at least one fastener is in an unfastened position, the at least one fastener allows limited rotational movement of the holder relative to the base to allow alignment of the level indicator relative to a reference plane, and when the level indicator is aligned relative to the reference plane, the at least one fastener is in arranged in a fastened position in which the fastener forces the base projection and the holder projection together to inhibit movement of the holder relative to the base.

13. A sight level as recited in claim 12, in which the holder defines first and second holder projections, where the base projection is arranged between the first and second holder projections to allow movement of the holder around the sight and to prevent movement of the holder along a longitudinal axis of the site.

14. A sight level as recited in claim 12, in which:

the at least one base void is a threaded opening formed in the base projection;

the at least one holder void is an elongate slot formed in the holder projection; and the at least one fastener is a screw that extends through the elongate slot and is received by the threaded opening such that the screw may be arranged to allow the holder to be moved relative to the base within a limited range defined by the elongate slot, and the screw may be arranged to force the base projection and the holder projection together to inhibit relative movement between the base and the holder.

15. A sight level as recited in claim 13, in which:

the at least one base void is first and second threaded openings formed in the base projection;

the at least one holder void is first and second elongate slots formed in the first and second holder projections, respectively; and the at least one fastener is first and second screws that extend through the first and second elongate slots and are received by the first and second threaded openings such that arrangement of the first and second screws in an unfastened position allows the holder to be moved relative to the base within a limited range defined by the elongate slots, and arrangement of at least one of the first and second screws in a fastened position causes at least one of the first and second screws to force at least one of the first and second base projections towards the holder projection to inhibit relative movement between the base and the holder.

16. A sight level as recited in claim 13, in which:

the at least one base void is first, second, third, and fourth threaded openings formed in the base projection;

the at least one holder void is first and second elongate slots formed in the first holder projection and third and fourth elongate slots formed in the second holder projection; and the at least one fastener is first, second, third, and fourth screws that extend through the first, second, third, and fourth elongate slots and are received by the first, second, third, and fourth threaded openings such that arrangement of the first, second, third, and fourth screws in an unfastened position allows the holder to be moved relative to the base within a limited range defined by the elongate slots, and arrangement of at least one of the first, second, third, and fourth screws in a fastened position causes at least one of the first, second, third, and fourth screws to force at least one of the first and second base projections towards the holder projection to inhibit relative movement between the base and the holder.

17. A sight level as recited in claim 12, in which:

the at least one base void defines first and second threaded holes;

the at least one holder void comprises a through hole and an elongate slot; and the at least one fastener comprises first and second fasteners; wherein the first fastener extends through the through hole and into the first threaded hole to allow pivoting movement of the holder relative to the base; and the second fastener extends through the elongate slot and into the second threaded hole such that arrangement of the second screw in an unfastened position allows the holder to be pivoted relative to the base within a limited range defined by the elongate slot, and arrangement of the second screw in a fastened position causes second screw to force the base projection towards the holder projection to inhibit relative movement between the base and the holder.

18. A sight level as recited in claim 13, in which:

the at least one base void defines first, second, and third threaded holes;

the at least one holder void comprises a first through hole and a first elongate slot formed in the first holder projection, and a second through hole and a second elongate slot formed in the second holder projection; and the at least one fastener comprises first, second, and third fasteners; wherein the first fastener extends through the first and second through holes and the first threaded hole to allow pivoting movement of the holder relative to the base; and the second and third fasteners extend through the first and second elongate slots and into the second and third threaded holes, respectively, such that arrangement of the second and third screws in an unfastened position allows the holder to be pivoted relative to the base within a limited range defined by the elongate slots, and arrangement of at least one of the second and third screws in a fastened position causes at least one of the second and third screws to force at least one of the first and second base projections towards the holder projection to inhibit relative movement between the base and the holder.

19. A sight level as recited in claim 12, in which the base comprises first and second clamp members that frictionally engage the sight to inhibit movement of the base relative to the sight.

* * * * *